US010989017B2

(12) United States Patent
Wardley et al.

(10) Patent No.: US 10,989,017 B2
(45) Date of Patent: Apr. 27, 2021

(54) METHOD OF ABANDONING A WELL

(71) Applicant: Ardyne Holdings Limited, Aberdeen (GB)

(72) Inventors: Michael Wardley, Aberdeen (GB); George Telfer, Aberdeen (GB); Alan Fairweather, Aberdeenshire (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 0 days.

(21) Appl. No.: 16/416,897

(22) Filed: May 20, 2019

(65) Prior Publication Data

US 2019/0301265 A1 Oct. 3, 2019

Related U.S. Application Data

(62) Division of application No. 15/562,523, filed as application No. PCT/GB2016/050920 on Mar. 31, 2016, now abandoned.

(30) Foreign Application Priority Data

Apr. 1, 2015 (GB) ..... 1505620

(51) Int. Cl.

| | |
|---|---|
| ***E21B 33/13*** | (2006.01) |
| ***E21B 33/16*** | (2006.01) |
| ***E21B 47/005*** | (2012.01) |
| ***E21B 29/00*** | (2006.01) |
| ***E21B 47/10*** | (2012.01) |

(52) U.S. Cl.

CPC ..... *E21B 33/13* (2013.01); *E21B 29/00* (2013.01); *E21B 29/002* (2013.01); *E21B 47/005* (2020.05)

(58) Field of Classification Search

None

See application file for complete search history.

(56) References Cited

U.S. PATENT DOCUMENTS

| | | | |
|---|---|---|---|
| 1,867,289 | A | 7/1932 | Ercole |
| 4,688,640 | A | 8/1987 | Pritchard, Jr. |
| 5,423,387 | A | 6/1995 | Lynde |
| 5,472,052 | A | 12/1995 | Head |

(Continued)

FOREIGN PATENT DOCUMENTS

| | | | |
|---|---|---|---|
| CA | 2181668 | A1 | 1/1998 |
| CN | 102606105 | B | 9/2014 |

(Continued)

OTHER PUBLICATIONS

Abshire et al.; "Offshore Permanent Well Abandonment"; Oilfield Review; vol. 24, No. 1; pp. 42-50; 2012.

(Continued)

*Primary Examiner* — Charles R Nold

(74) *Attorney, Agent, or Firm* — Law Office of Jesse D. Lambert, LLC

(57) ABSTRACT

The invention provides a method of determining the condition of a cement bond of a casing in a wellbore. The method comprises perforating a tubing in the wellbore at a zone of interest and displacing a settable composition through the perforations into the annulus between the casing and tubing to secure the tubing. The method also comprises cutting the tubing and assessing the status of the cement bond of the casing.

9 Claims, 5 Drawing Sheets

(56) References Cited

U.S. PATENT DOCUMENTS

| | | | |
|---|---|---|---|
| 6,330,919 | B1 | 12/2001 | McGarian |
| 6,478,088 | B1 | 11/2002 | Hansen et al. |
| 9,797,240 | B2 * | 10/2017 | Tunget ..... E21B 7/20 |
| 2007/0163793 | A1 | 7/2007 | Aeberhard et al. |
| 2008/0035377 | A1 | 2/2008 | Sullivan et al. |
| 2008/0156494 | A1 | 7/2008 | Abadie |
| 2009/0321592 | A1 | 12/2009 | Bryant et al. |
| 2010/0038080 | A1 | 2/2010 | McAfee et al. |
| 2010/0155085 | A1 | 6/2010 | Spencer |
| 2010/0163244 | A1 | 7/2010 | Desai et al. |
| 2011/0209872 | A1 | 9/2011 | McAfee et al. |
| 2012/0325480 | A1 | 12/2012 | Schmidt et al. |
| 2014/0352964 | A1 | 12/2014 | Surjaatmadja et al. |
| 2015/0129195 | A1 | 5/2015 | Laird et al. |
| 2015/0152708 | A1 | 6/2015 | Smith |
| 2015/0211314 | A1 | 7/2015 | McAfee et al. |
| 2015/0275606 | A1 | 10/2015 | Segura et al. |
| 2015/0361759 | A1 | 12/2015 | Kjørholt et al. |
| 2016/0010423 | A1 | 1/2016 | Myhre et al. |
| 2016/0076341 | A1 | 3/2016 | Burguieres et al. |
| 2016/0230499 | A1 | 8/2016 | Hemmingsen et al. |

FOREIGN PATENT DOCUMENTS

| | | | |
|---|---|---|---|
| EP | 3085883 | A1 | 10/2016 |
| GB | 337781 | A | 11/1930 |
| GB | 365197 | A | 1/1932 |
| GB | 2275282 | A | 8/1994 |
| GB | 2437467 | B | 12/2007 |
| GB | 2494780 | B | 11/2015 |
| GB | 2543167 | B | 1/2018 |
| RU | 2533563 | C1 | 11/2014 |
| WO | 9215767 | A1 | 9/1992 |
| WO | 9957409 | A2 | 11/1999 |
| WO | 03101656 | A1 | 12/2003 |
| WO | 2010065994 | A1 | 6/2010 |
| WO | 2011031164 | A1 | 3/2011 |
| WO | 2013109248 | A1 | 7/2013 |
| WO | 2013133719 | A1 | 9/2013 |
| WO | 2014108431 | A2 | 7/2014 |
| WO | 2015088553 | A1 | 6/2015 |
| WO | 2015150828 | A3 | 3/2016 |
| WO | 2016048158 | A1 | 3/2016 |

OTHER PUBLICATIONS

Bard Martin Tinnen; "Plugging and Abandonment"; AkerSolutions; Jun. 19, 2013.

European Search and Examination Report dated Sep. 29, 2016 for Application No. GB1605521.2.

International Search Report dated Nov. 4, 2016 for PCT/GB2016/050920.

* cited by examiner

METHOD OF ABANDONING A WELL

CROSS-REFERENCE TO RELATED APPLICATIONS

This application is a divisional of U.S. patent application Ser. No. 15/562,523, having a filing date of Sep. 28, 2017, which itself is a U.S. National Phase Application Under 35 U.S. C. § 371 of International Patent Application No. PCT/GB2016/050920, having a filing date of Mar. 31, 2016, and claims the priority of GB 1505620.3, having a filing date of Apr. 1, 2015, all of which are incorporated by reference in their entireties and all commonly owned.

FIELD OF THE INVENTION

The present invention generally relates to the field of hydrocarbon exploration and more specifically to methods of efficiently abandoning wells when they have come to the end of their useful life.

BACKGROUND OF THE INVENTION

In order to make the wellbore safe and to meet regulatory standards, it is necessary to set several plugs within the wellbore to resist any build-up of pressure that may occur in the future. In order to prepare the wellbore for the setting of such plugs it is necessary to remove the production tubing from the well.

Tubing removal is a costly operation requiring the employment of expensive equipment, such as a drilling rig. The present invention seeks to provide a more cost-effective solution by leaving at least some of the tubing in the well, whilst providing confirmation that the well has been left in a safe state.

In the course of constructing an oil or gas well, a hole is drilled to a pre-determined depth. The drilling string is then removed and a metal tubular or casing is run into the well. When the casing reaches the bottom of the well, cement is pumped down the casing and displaced up the annulus between the casing and the original wellbore.

The function of the cement is to secure the casing in position and ensure that the annulus is sealed. This process of drilling, running casing and cementing is repeated with successively smaller drilled holes and casing sizes until the well reaches its target depth.

At this point, a final tubular or tubing is run into the well. The tubing is secured at its top and at its bottom end, but it is not cemented in place so as to facilitate potential remedial operations, such as removal and replacement of the tubing in the event that it becomes damaged or corroded. A valve, known as a downhole safety valve, is positioned in the upper part of the tubing typically 500 ft below the wellhead. Should a safety problem occur, this valve can be closed to seal in pressure.

Activation of the valve is accomplished by applying pressure from surface down control lines running alongside and clamped to, the tubing. During the well construction phase, after each cementing operation, confirmation of the quality of the cement sheath around the casing is desired. A typical way of providing such confirmation would be to carry out a cement bond log (CBL).

The CBL will confirm whether the quality of the cement sheath is adequate. If it proves that the CBL shows that the cement quality is not adequate certain remedial operations may be possible. These processes are necessary so that when the construction phase is complete, the well operator has a record demonstrating that the successive annuli are secure. The well may now be put on production, with the hydrocarbons flowing up the tubing and gathered at surface. Over time, which may be several decades, the production of hydrocarbons reduces until the production rate is no longer economically viable, at which point the well has reached the end of its productive life.

The well now needs to be plugged and abandoned. Although regulations vary between jurisdictions, a universal requirement is that the abandoned well should not leak hydrocarbons at any point in the future. In abandoning the well, the operator has the primary legal responsibility to demonstrate to the regulatory authorities that everything practical has been done to ensure a secure abandonment.

Ordinarily, the CBL record would form part of the evidence that the operator would produce to support the case for a securely abandoned well, however in many cases the CBL record may not be available, or the quality of the CBL record may not be adequate, due to the limitations of the technology of the day or due to the acceptance criteria having become more stringent. It may even be the case that the operator has a good CBL, but decides that the risk of a leak is still too high given the uncertainty of the future regulatory framework and associated penalties.

Unless the operator is both able and willing to convince the regulatory authorities that the cement bond is acceptable, they have to contemplate how to arrive at a position of acceptance. In many cases, it is decided that the best method is to gain access to the cemented casing by removing the final tubing from the well. In order to gain access to the casing for which a new CBL needs to be carried out, the operator needs to remove the final tubing from at least that point up to the surface of the well. This is because cement bond logs cannot be made through two strings of metal tubular.

One method of doing this would be to pull the entire tubing string, alternatively the tubing can be cut just below the point of interest and the tubing above pulled from the well, leaving the lower portion in place. In either event, costly surface equipment such as a drilling rig capable of pulling tubing needs to be provided. A CBL can now be carried out. In the event that the CBL is shown to be good, the operator can set a cement plug inside the casing and move up the well to the next zone of interest. This may be repeated several times until the entire well is deemed secure.

If however the CBL shows the cement to be of insufficient quality, the operator now has the choice either to mill away the casing and the old cement over a sufficiently long section and place a new cement plug or alternatively to perform a remedial cement job. Remedial cementing would involve perforating the casing, washing out as much of the old cement as possible and squeezing new cement through the perforations, known as a perforate, wash and squeeze job, whilst also leaving a cement plug within the casing. It can now be seen that the default option for the situation where existing data shows the cement to be of uncertain quality, or where there is no data available is to remove the tubing from at least that point up to the surface of the well. As has been explained, this is necessarily an expensive process.

However, it can be seen that removal of the tubing is merely a facilitator in determining whether the cement bond is adequate, if the cement bond is shown to be inadequate then tubing removal has been justified, but if the cement bond is adequate then tubing removal has proved to be an unwarranted expense. Even in the situation where all the CBL's show that the cement quality is good, the operator still has to remove the upper part of the tubing. This is because an upper cement plug needs to be set just below the wellhead.

SUMMARY OF THE INVENTION

It is an object of at least one aspect of the present invention to obviate or at least mitigate the foregoing disadvantages of prior art methods for abandoning a well.

It is another object of an aspect of the present invention to provide a method of determining the status of a cement bond without removing the production tubing from the well.

It is further object of at least one aspect of the present invention to provide a method to determine whether it is required to remove the tubing after the adequacy of the cement bond is known. It will be shown that in those cases where the cement bond is shown to be adequate there are significant savings to be made over the methods employed during current practices.

It is another object of an aspect of the present invention to provide a reliable, quick and cost efficient method of abandoning a well.

Further aims and objects of the invention will become apparent from reading the following description.

According to a first aspect of the invention, there is provided a method of determining the condition of a cement bond of a casing in a wellbore comprising;

perforating a production tubing in the wellbore at a zone of interest;

displacing a settable composition through the perforations into the annulus between the;

casing and tubing to secure the production tubing;

cutting the tubing; and assessing the status of the cement bond of the casing.

The method may comprise running a perforating tool through the tubing to a predetermined and/or desired depth.

The method may comprise perforating the tubing using explosive charges or a perforating tool.

Preferably the settable composition supports the tubing and secures the tubing in position. The method may comprise securing the tubing rigidly in position in the wellbore. Preferably, the method comprises securing the tubing rigidly by allowing the settable composition to set hard in the annulus between the casing and tubing. The method may comprise securing the tubing temporarily in position before the cutting and/or milling operation is started.

The method may comprise providing a tubing cutter to cut a slot through a wall of the production tubing. The method may comprise deploying a milling tool to mill away the tubing. The method may comprise milling away the securing settable composition in the annulus between the casing and the tubing. The method may comprise milling in an upward or downward direction. The method may comprise milling away the tubing up to the top of the securing settable composition.

Preferably the method comprises assessing the quality of the cement bond at a zone of interest by deploying a cement bond logging tool through the tubing to the zone of interest.

The method may comprise pulling the tubing out of the casing if the cement bond is shown to be of poor quality. The method may comprise deploying a cement plug if the cement bond is shown to be of adequate and/or good quality.

The method may further comprise assessing the quality of the cement of a second zone by running a tubing cutter tool in the tubing and cutting the tubing at the upper end of the second zone. The method may comprise cutting the tubing and dropping the cut tubing further downhole. By dropping the tubing further downhole the second zone is exposed and the quality of the cement of a second zone may be assessed.

The method may comprise assessing the quality of the cement bond at multiple zones. The method may comprise running a tubing cutter tool in the tubing and cutting and/or milling the tubing at a second and/or further zone to expose the cement bond to allow assessment of the quality of the cement bond.

The method may comprise positioning the cutting tool higher up the well in the event a cement bond is not identified in the second and/or further zone. The method may comprise making further cuts to the tubing and exposing cement bonds until a zone with good quality cement is identified.

It will be appreciated that wells vary in complexity and there may be either more or less zones of interest than described above, however it will also be appreciated that the sequences of operation described heretofore can be applied as many times as are necessary and are not limited to two zones of interest.

The settable composition may be selected from the group comprising cement, resin and/or gel.

Preferably, the settable composition is cement. The method may comprise deploying a cementing tool to displace a pre-determined amount of cement through the perforations into the annulus between the casing and the tubing.

The current invention provides a method for determining the status of a cement bond without removing the tubing from the well. As has been seen, removal of the tubing is an expensive process which in certain circumstances may have proved to be unnecessary.

The tubing is perforated at the zone of interest and cement, resin and/or gel is displaced through the perforations into the annulus between the casing and tubing. The cement resin and or gel is then allowed to set.

The tubing is then cut and milled away, along with the previously placed cement, resin and/or gel. Under normal circumstances it would not be possible to mill tubing because it is not supported securely in the lateral direction. Any attempt at milling would fail due to vibration and the milling tools would be quickly damaged. According to the current invention however there is an intermediate step of providing cement, resin and/or gel to the tubing over the zone of interest. The cement, resin and/or gel holds the tubing securely in place whilst the tubing milling operation is carried out.

A CBL logging tool can then be run through the tubing to the milled-away section and a log taken of the cemented section outside the casing. The advantage gained by performing these operations is that they can all be done by using a low cost surface package, for example a boat rather than a rig. The status of the cement bond can thus be established before the tubing has been removed. Where the cement proves to be of adequate quality, the tubing need not be removed.

Where the cement proves to be of inadequate quality, the operator now has the choice of performing a perforation, wash and squeeze job to improve the cement behind the casing, or the well is suspended pending availability of an appropriate rig and then the tubing can justifiably be removed. In the case where the cement is of adequate quality, the next operation would be to move up the well to the next zone of interest (if any), however at this point there is no need to perforate, cement and mill away the tubing. The tubing is simply cut at the top of the zone of interest.

The tubing is then free to fall under gravity into the space created by the previous tubing milling operation and the next CBL can be taken and the process repeated. Thus it can be seen that tubing need not be removed from the well unless and until a poor quality cement is detected and even then, a perforation, wash and squeeze job may still obviate the need to remove tubing. If all the cement bonds are good then no tubing is removed at all, obviating the need for an expensive rig on location entirely. If only some of the cement bonds are of good quality, then less tubing may need to be removed and this amount has been justified by obtaining the CBL information before taking the decision to deploy a rig.

According to a second aspect of the invention, there is provided a method for abandoning a well comprising:

determining the condition of a cement bond of a casing in a wellbore according to the first aspect of the invention and pulling the production tubing out of the wellbore and/or deploying a cement plug.

Preferably the method comprises assessing the quality of the cement bond at a zone of interest by deploying a cement bond logging tool through the tubing to the zone of interest.

The method may comprise pulling the tubing out of the casing if the cement bond is shown to be of poor quality. The method may comprise deploying a cement plug if the cement bond is shown to be of adequate and/or good quality.

The method may comprise assessing the quality of the cement of a second zone by running a tubing cutter tool in the tubing and cutting the tubing at the upper end of the second zone. The method may comprise cutting the tubing and dropping the cut tubing further downhole. By dropping the tubing further downhole the second zone is exposed and the quality of the cement of a second zone may be assessed.

The method may comprise assessing the quality of the cement bond at multiple zones. The method may comprise running a tubing cutter tool in the tubing and cutting and/or milling the tubing at a second or further zone to expose the cement bond to allow assessment of the quality of the cement bond.

The method may comprise positioning the cutting tool higher up the well in the event a good quality cement bond is not identified in the second and/or further zone. The method may comprise making further cuts to the tubing and exposing cement bonds until a zone with good quality cement is identified.

Embodiments of the second aspect of the invention may include one or more features of the first aspect of the invention or its embodiments, or vice versa.

According to a third aspect of the invention, there is provided a method of milling a production tubing section in a wellbore casing comprising [0054] perforating the tubing section;

passing settable composition through the perforations into the annulus between the casing and tubing to secure the tubing; and [0056] milling the tubing section and the settable composition securing the tubing section.

The method may comprise perforating the tubing using explosive charges or a perforating tool.

The method may comprise running a perforating tool through the tubing to a predetermined and/or desired depth.

Preferably the settable composition supports the tubing and secures it in position. Preferably, the method comprises rigidly securing the tubing by allowing the settable composition to set hard in the annulus between the casing and tubing. The method may comprise securing the tubing temporarily in position before the milling operation is started.

The method may comprise providing a tubing cutter to cut a slot through the wall of the tubing. The method may comprise deploying a milling tool to mill away the tubing. The method may comprise milling away the settable composition in the annulus between the casing and tubing. The method may comprise milling in an upward or downward direction in the wellbore. The method may comprise milling away the tubing up to the top of the securing cement.

The settable composition may be selected from the group comprising cement, resin and/or gel.

Preferably, the settable composition is cement. The method may comprise deploying a cementing tool to displace a pre-determined amount of cement through the perforations into the annulus between the casing and the tubing.

Embodiments of the third aspect of the invention may include one or more features of the first or second aspect of the invention or their embodiments, or vice versa.

According to a fourth aspect of the invention, there is provided a method of determining the condition of a cement bond of a casing in a wellbore comprising;

cutting the production tubing at a zone of interest;

dropping at least a section of the production tubing downhole; and assessing the status of the cement bond of the casing.

The method may comprise running a cutting tool through the tubing to a predetermined and/or desired depth.

The method may comprise cutting a slot through a wall of the production tubing. The method may comprise deploying a milling tool to mill away the tubing. The method may comprise milling in an upward or downward direction.

Preferably the method comprises assessing the quality of the cement bond at a zone of interest by deploying a cement bond logging tool through the production tubing to the zone of interest.

The method may comprise pulling the tubing out of the casing if the cement bond is shown to be of poor quality. The method may comprise deploying a cement plug if the cement bond is shown to be of adequate and/or good quality.

The method may further comprise assessing the quality of the cement of a second zone by running a tubing cutter tool in the tubing and cutting the tubing at the upper end of the second zone. The method may comprise cutting the tubing and dropping the cut tubing further downhole. By dropping the tubing further downhole the second zone is exposed and the quality of the cement of a second zone may be assessed.

The method may comprise assessing the quality of the cement bond at multiple zones. The method may comprise running a tubing cutter tool in the tubing and cutting and/or milling the tubing at a second or further zone to expose the cement bond to allow assessment of the quality of the cement bond.

The method may comprise positioning the cutting tool higher up the well in the event a cement bond is not identified in the second and/or further zone. The method may comprise making further cuts to the tubing and exposing cement bonds until a zone with good quality cement is identified.

The method may comprise cutting and/or milling the production tubing at a position in the wellbore lower than the zone of interest prior to cutting the production tubing at the zone of interest to provide and/or create a space for the protection tubing to fall when the production tubing is cut at a zone of interest. The term "lower" in this context means a position further from the surface than the zone of interest.

Embodiments of the fourth aspect of the invention may include one or more features of the first to third aspects of the invention or their embodiments, or vice versa.

According to a fifth aspect of the invention, there is provided a method of allowing a section of tubing in a well to be milled, wherein the tubing is temporarily secured rigidly in position before the milling operation is started.

The method may comprise securing the tubing by perforating the tubing and cementing through the perforations.

The method may comprise securing the tubing by perforating the tubing and displacing resin and/or gel through the perforations.

The method may comprise subsequently assessing the quality of cement outside the casing surrounding the tubing.

The method may comprise cutting the tubing a distance above the milled section. The method may comprise relocating the section of tubing below the cut further down the well.

Embodiments of the fifth aspect of the invention may include one or more features of the first to fourth aspects of the invention or their embodiments, or vice versa.

BRIEF DESCRIPTION OF THE DRAWINGS

There will now be described, by way of example only, various embodiments of the invention with reference to the following drawings (like reference numerals referring to like features) in which.

DETAILED DESCRIPTION OF THE EMBODIMENTS

Figure 1:
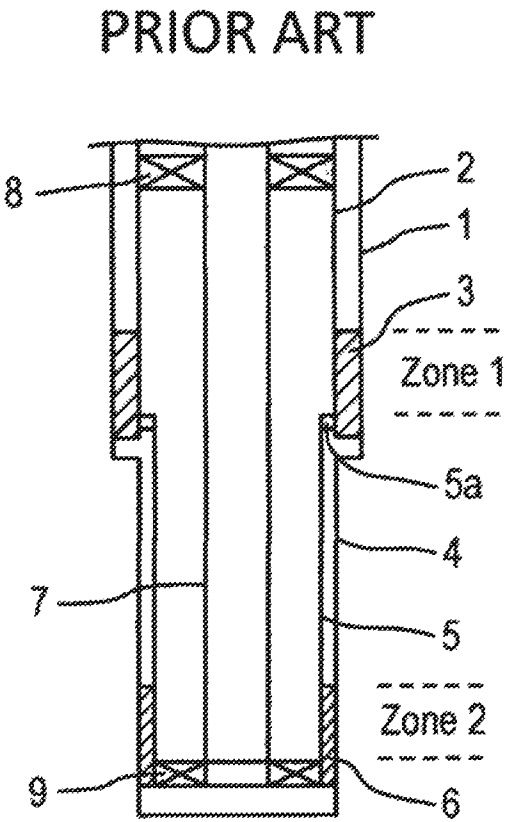
FIG. 1 shows a sectional diagram of a typical well with two strings of casing and tubing installed.

FIG. 1 shows a typical well with two strings of casing and tubing installed. The initial section of wellbore 1 was drilled to a certain depth, after which casing 2 was run into the well. Cement 3 was set over a portion of the outside of the casing 2, sealing the annulus between the casing 2 and the wellbore 1. The next section of wellbore 4 was then drilled to the target depth of the well. A next section of casing 5 was run into the well, suspended inside the first casing 2 with a hanger 5*a* and likewise cemented 6 to seal the annuls between the second casing 5 and the wellbore 4. Production tubing 7 was then run into the wellbore and suspended at its upper end with a hanger 8 and sealed and anchored at its lower end by a packer 9. As has been described, when it comes time to abandon the well the cement sheaths at zone 1 and zone 2 need to be assessed for quality.

Figure 2A:
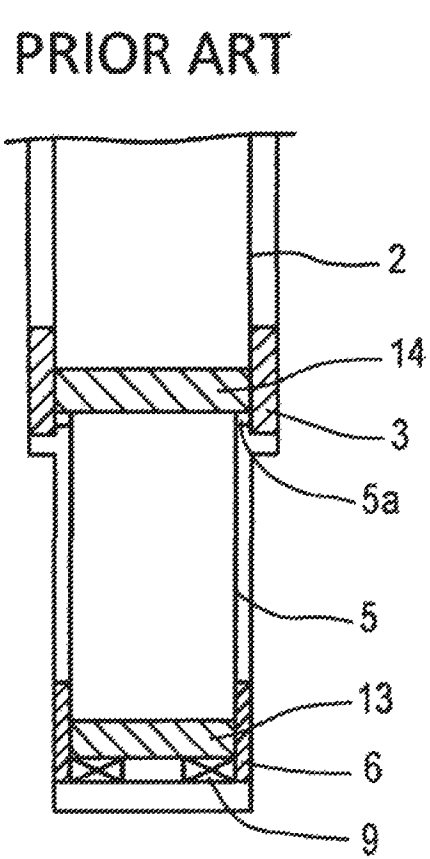
FIG. 2*a* shows a sectional diagram of well of FIG. 2 after cement plugs have been set according to current practice.
Figure 2:
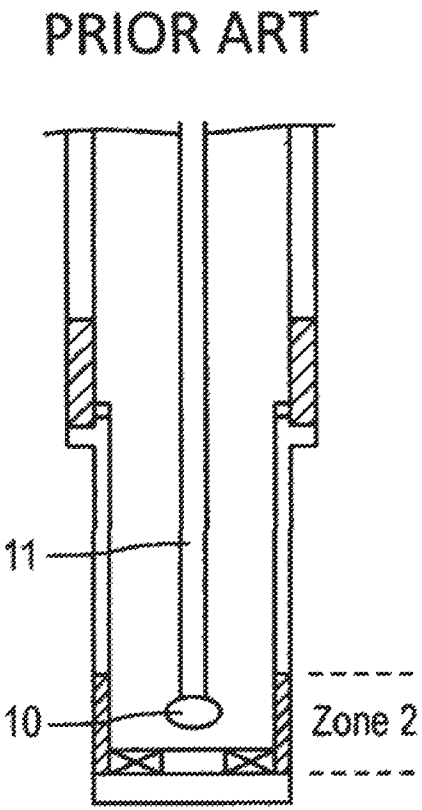
FIG. 2 shows a sectional diagram of the well of FIG. 1 demonstrating the current practice of removing the tubing before performing a CBL to assess the cement bond.

FIG. 2 shows a typical operations demonstrating current practice. In order to expose zone 2 for assessment, the tubing 7 and tubing hanger 8 have been removed by deploying a drilling rig. A cement bond logging tool 10 is now deployed on drill pipe, coiled tubing or wireline 11. Only when the CBL has been assessed will it be known whether the operation to remove the tubing was worthwhile.

FIG. 2*a* shows a typical well after plugs have been set according to current practice. A lower cement plug 13 has been set inside casing 5 just above the packer 9. This plug 13 in combination with the previously set cement 6 provides a barrier at the lower part of the well. An upper cement plug 14 has been set inside casing 2 just above hanger 5*a*. This plug in combination with the previously set cement 3 provides a barrier at an intermediate position in the well.

Figure 3A:
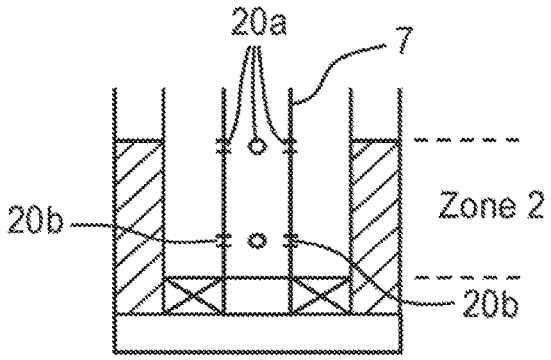
FIGS. 3*a* to 3*f* show sectional diagrams of a well demonstrating the typical sequence of operations to assess the condition of a cement bond at zone 2 according to the current invention.

FIGS. 3*a-f* show a typical sequence of operations according to the current invention and in particular show zone 2 in detail. According to the present invention the first operation is to perforate the tubing. In FIG. 3*a*, a perforating tool (not shown) is run through the tubing 7 to a first desired depth and explosive charges produce holes 20*a* in the tubing 7. The perforating tool (not shown) is moved to a second desired depth and explosive charges produce holes 20*b* in the tubing 7.

Figure 3B:
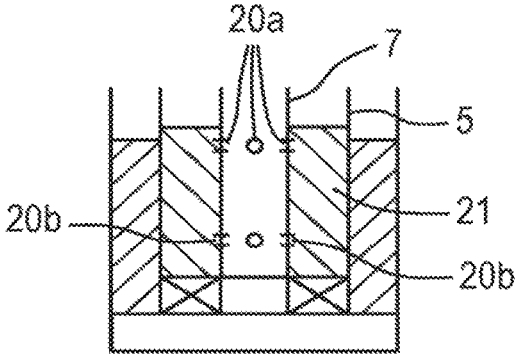

In FIG. 3*b*, a downhole tool (not shown) deploys a pre-determined amount of a settable composition 21, through the lower set of perforations 20*b* into the annulus between the casing 5 and the tubing 7. In this exemplary embodiment, cement is used as a settable composition 21. When the pre-determined amount of cement has been deployed through the lower set of perforations 20*b* the level of cement has reached the upper set of perforations 20*a* in the tubing 7. The downhole tool may have sensors to detect cement coming back into the tubing through the upper set of perforations 20*a*.

Figure 3C:
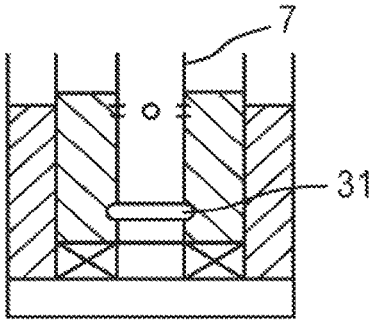
Figure 3D:
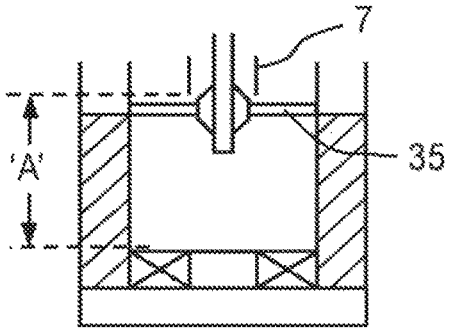
Figure 3E:
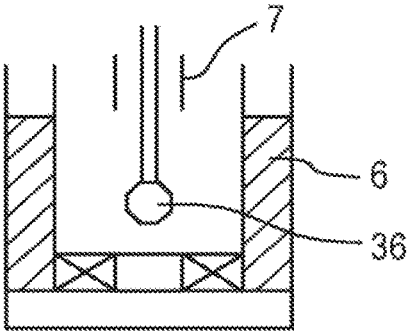
Figure 3F:
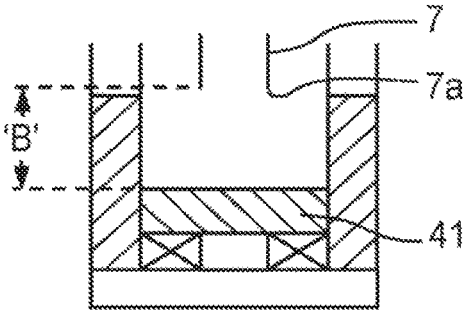

The cement 21 is then allowed to set hard, thus securing the tubing 7 rigidly in preparation for the next operations. In FIG. 3*c*, a tubing cutter (not shown) is deployed, cutting a slot 31 through the wall of the tubing 7, and FIG. 3*d* shows a tubing mill 35 deployed through, and milling away the tubing 7 up to the top of the previously placed cement 21. The length of tubing 7 milled away is pre-planned and is labelled 'A' and might typically be 200 ft. The tubing mill 35 is removed from the well. In FIG. 3*e*, a cement bond logging tool 36 is deployed through the tubing 7 to assess the quality of the cement 6 of zone 2. If the cement is shown to be of poor quality, then the well is suspended pending deployment of a rig to pull the tubing as per FIG. 2. However, if the cement 6 is shown to be of adequate quality the next operation, as shown in FIG. 3*f*, is to run a cementing tool (not shown) and deploy a cement plug 41 at the lower end of the milled section 'A'.

Typically, the cement plug 41 might be 100 ft thick. Importantly, this leaves a gap 'B' of 100 ft for example, between the lower end of the tubing 7*a* and the top of the cement plug 41.

Figure 4:
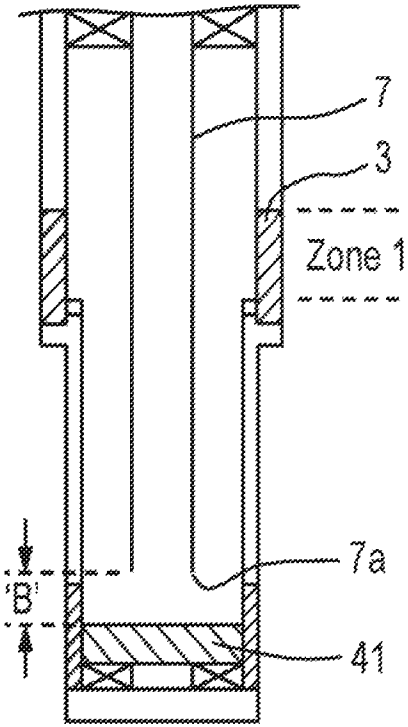

FIG. 4 shows the state of the well after the operations of FIGS. 3*a-f*. The lower part of the well (zone 2) has been secured and a gap 'B' has been left between the lower end of the tubing 7*a* and the top of the cement plug 41. The next operation is to assess the quality of the cement over zone 1. However due to the gap 'B' left below the lower end of the tubing 7*a* it is not necessary to repeat the operation of FIGS. 3*a-f*. In order to expose the cement 3 of zone 1 for assessment of the cement quality, a tubing cutter (not shown) is run and the tubing 7 is cut at the upper end of zone 1. Upon cutting the tubing 7, the lower part is able to fall under gravity until it lands on top of the cement plug 41.

Figure 6:
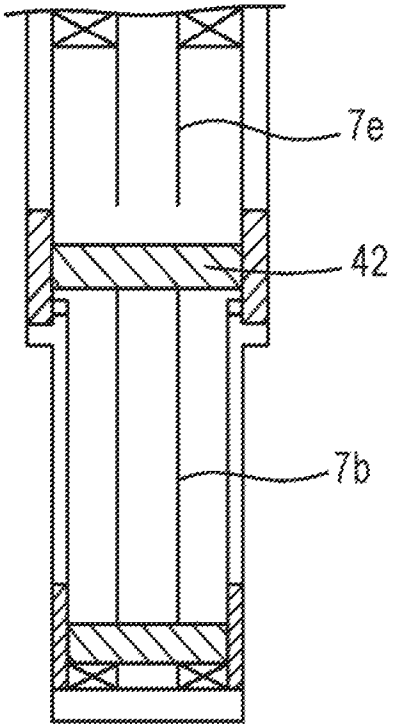
FIGS. 4 to 6 shows sectional diagrams of a well demonstrating the typical sequence of operations to assess the condition of a cement bond at zone 1 according to a second embodiment of the invention.
Figure 5:
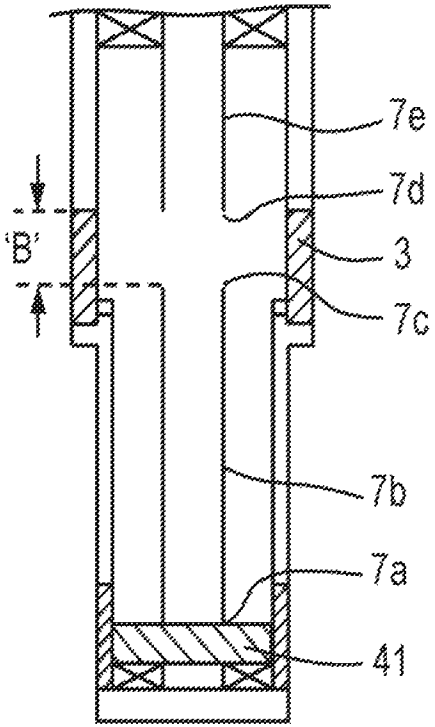

FIG. 5 shows the lower part of the tubing 7*b* with its lower end 7*a* located on the cement plug 41. There is now a gap of length 'B' between the upper end 7*c* of the lower part of the tubing 7*b* and the lower end 7*d* of the upper part of the tubing 7*e*. This gap 'B' has now exposed zone 1 for assessment of the quality of the cement 3. In a similar manner as previously described, a cement bond logging tool now assesses the cement quality and if poor, the well is suspended until a rig is available to pull the tubing 7*e* from the well. If the cement quality is good, then, again as previously described, a cementing tool is run to place a cement plug 42 in the lower part of gap 'B'. In the case where there are only two zones of interest, operations concerning the tubing 7*b* and 7*e* are complete and the final state of the well is shown in FIG. 6.

The term "upper part" in this context means that this part is closer to the surface than the "lower part". In general, relative terms such as "upper" and "lower" are used to indicate directions and locations as the apply to the drawings.

Figure 7A:
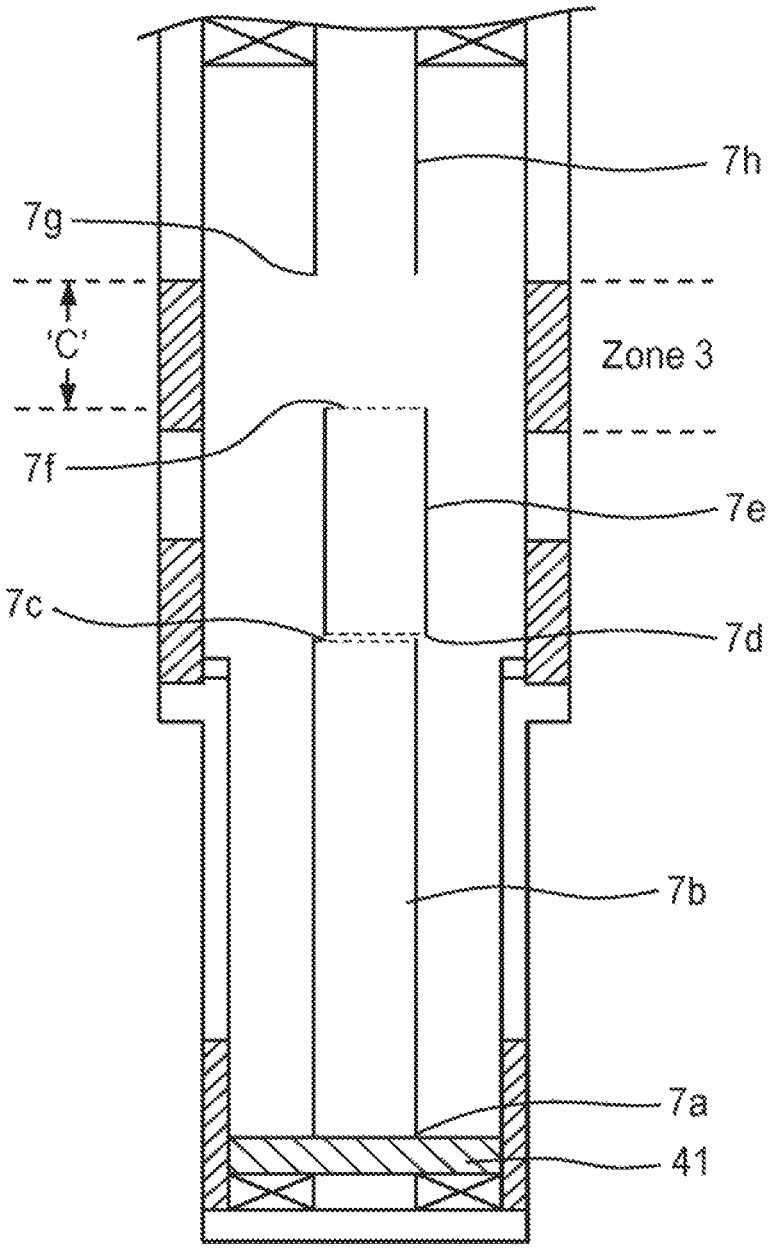
FIGS. 7*a* and 7*b* shows sectional diagrams of a well demonstrating the typical sequence of operations to assess the condition of a cement bond at zone 3 according to a further embodiment of the invention.

If the cement quality at zone 1 is poor, an alternative to pulling the tubing 7*e* from the well is to move the cutting tool upward in the wellbore to a depth closer to the surface and a make a further cut in the tubing as shown in FIG. 7*a*.

FIG. 7*a* shows that when the further cut in the tubing is made the cut section of tubing 7*e* drops down the well onto the previously cut tubing section 7*b* and exposes a new section of casing for evaluation of the cement bond. The tubing 7*e* with its lower end 7*d* is located on the upper end 7*c* of the lower part of the tubing 7*b*. There is now a gap of length 'C' between the tubing end 7*f* of the tubing 7*e* and the lower end 7*g* of the upper part of the tubing 7*h*. This gap 'C' has now exposed zone 3 for assessment of the quality of the cement 3.

Figure 7B:
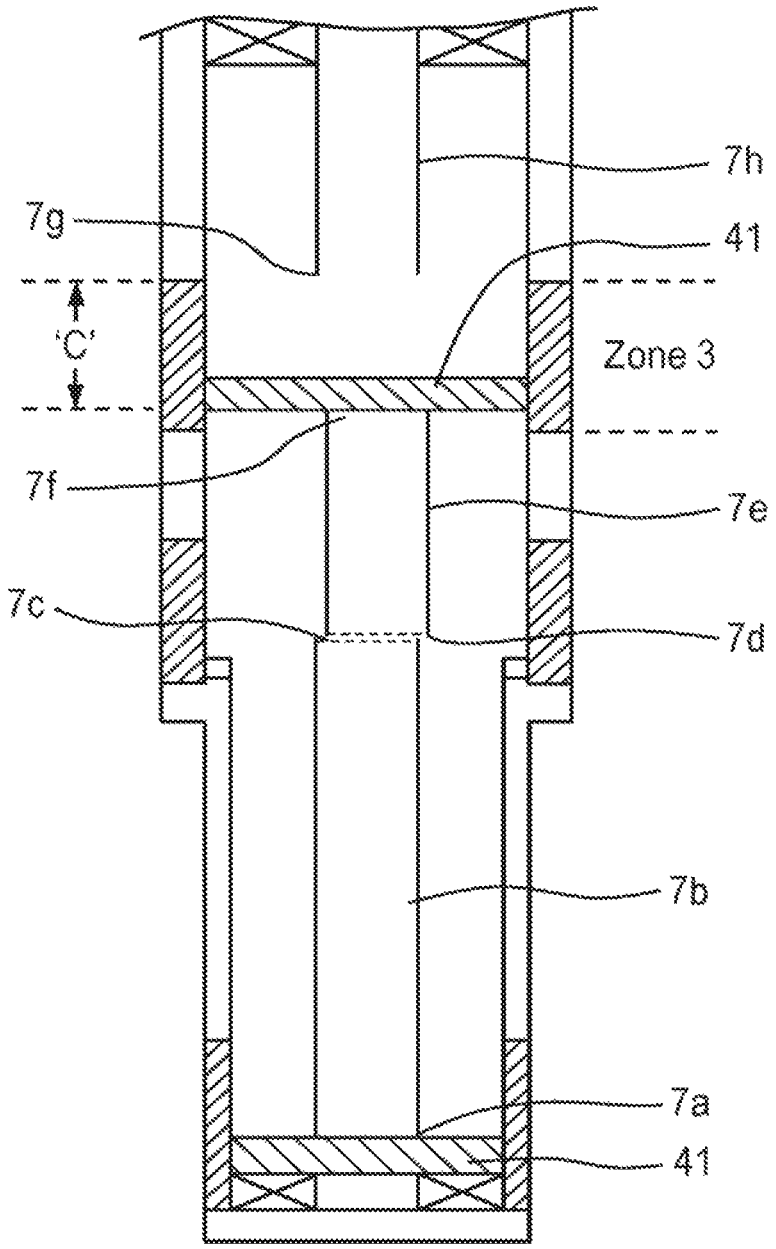

As previously described, a cement bond logging tool now assesses the cement quality and if the cement quality is good, a cementing tool is run to place a cement plug 42 in the lower part of gap 'C' as shown in FIG. 7*b*.

If the cement quality is poor at zone 3, the cut and drop operation is repeated by moving the cutting tool upward in the wellbore to depths closer to the surface and a further cuts in the tubing are made until a zone with good quality cement is identified and a cement plug may be placed. By applying this cut and drop operation it is not required to provide costly surface equipment such as a drilling rig in order to pull the tubing and perform remedial operations.

It will be appreciated that wells vary in complexity and there may be either more or less zones of interest than described above, however it will also be appreciated that the sequences of operation described heretofore can be applied as many times as are necessary and are not limited to two zones of interest.

Throughout the specification, unless the context demands otherwise, the terms ' comprise' or 'include', or variations such as 'comprises' or 'comprising', 'includes' or 'including' will be understood to imply the inclusion of a stated integer or group of integers, but not the exclusion of any other integer or group of integers. Furthermore, relative terms such as "upper", "lower" and the like are used herein to indicate directions and locations as they apply to the appended drawings and will not be construed as limiting the invention and features thereof to particular arrangements or orientations.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention as defined by the appended claims.

The invention provides a method of reducing the cost of plugging a well during the course of the abandonment process; consisting of utilizing a low cost surface package, such as a boat, to perforate, cement and mill away a section of tubing to gain access to and perform a cement bond log (CBL) of the casing outside the tubing. Should the CBL prove the cement to be of adequate quality the tubing need not be removed from the well. In the event that the cement is of inadequate quality and depending on the particular circumstances the operator may choose either to perform remedial operations or the tubing may justifiably be removed.

The invention provides a method of determining the condition of a cement bond of a casing in a wellbore. The method comprises perforating a tubing in the wellbore at a zone of interest and displacing a settable composition through the perforations into the annulus between the casing and tubing to secure the tubing. The method also comprises cutting the tubing and assessing the status of the cement bond of the casing.

Although the invention has been described relative to various selected embodiments herein presented by way of example, there are numerous variations and modifications that will be readily apparent to those skilled in the art in light of the above teachings. It is therefore to be understood that, within the scope of the claims hereto attached and supported by this specification, the invention may be practiced other than as specifically described.

That which is claimed is:

1. A method for abandoning a well, the well including a cemented section behind a casing in a wellbore and production tubing within said casing at said cemented section, the well comprising a plurality of zones of interest including a first and second zone of interest, each zone of interest having a cement bond thereacross, the method comprising in sequence the steps of:

(a) perforating the production tubing in the wellbore at a first zone of interest at the cemented section; wherein perforating the production tubing comprises producing holes in the production tubing at a first and second depth over the first zone of interest, and (b) passing a settable composition through the perforations into the annulus between the casing and the production tubing; wherein passing a settable composition through the perforations comprises passing a settable composition in through the holes at said first depth and out through the holes at said second depth, wherein the second depth is higher in the well than the first depth, and (c) allowing the settable composition to set to secure the production tubing to the casing at said first zone of interest;

(d) deploying a milling tool to mill away the production tubing and the settable composition over said first zone of interest, forming an upper part and a lower part of the production tubing and leaving a gap between the upper part and lower part of the production tubing, to access the casing at the cemented section; and (e) performing a cement bond log to detect any leaks in the cemented section around the casing at said first zone of interest; and (f) deploying a cement plug atop the lower part of the production tubing if no leaks are detected at said first zone of interest, and (g) running a tubing cutter tool in the production tubing and cutting and/or milling the production tubing at the second zone of interest to expose the cement bond at said second zone of interest to detect any leaks in the cemented section around the casing at said second zone of interest if leaks are detected at the cement bond of the said first zone of interest, and cutting the production tubing and dropping the cut production tubing further downhole to expose the cement bond at the second zone of interest.

2. The method of claim 1 further comprising pulling said production tubing out of said casing if leaks are detected at the cement bond at said first zone of interest.

3. The method of claim 1 wherein said second zone of interest is higher in the well than said first zone of interest.

4. The method of claim 1 wherein said cement bond of said second zone of interest is exposed at the upper end of said second zone of interest.

5. The method of claim 1 further comprising deploying a cement plug if no leaks are detected in the cement bond at said second zone of interest.

6. The method of claim 1 further comprising running a tubing cutter tool in the production tubing and cutting and/or milling the production tubing at the plurality of zones of interest to expose the cement bond at said plurality of zones of interest to detect any leaks in the cemented section around the casing at each of said plurality zones of interest until at least one zone of interest is identified with no leaks detected if leaks are detected at said first zone of interest.

7. The method of claim 6 further comprising deploying a cement plug if at least one zone of interest is identified with no leaks detected.

8. The method of claim 1 wherein the step of performing the cement bond log comprises deploying a cement bond logging tool through the production tubing to the first zone of interest.

9. The method of claim 1 wherein a predetermined amount of settable composition is used to fill the annulus between the first and second depth.

* * * * *